United States Patent [19]

Blomqvist et al.

[11] Patent Number: 4,480,524

[45] Date of Patent: Nov. 6, 1984

[54] MEANS FOR REDUCING GUN FIRING DISPERSION

[75] Inventors: Åke Blomqvist; Roland Forsgren, both of Karlskoga, Sweden

[73] Assignee: Aktiebolaget Bofors, Bofors, Sweden

[21] Appl. No.: 310,334

[22] Filed: Oct. 9, 1981

[30] Foreign Application Priority Data

Oct. 27, 1980 [SE] Sweden ..... 8007529

[51] Int. Cl.[3] ..... F41F 1/00; F41G 3/00; F16F 15/02

[52] U.S. Cl. ..... 89/41 M; 89/41 ME

[58] Field of Search ..... 89/37 GM, 41 M, 42 B, 89/41 H, 41 SM, 41 A, 41 LE, 41 ME

[56] References Cited

U.S. PATENT DOCUMENTS

| | | | |
|---|---|---|---|
| 3,581,115 | 5/1971 | Weber | 328/55 X |
| 3,677,135 | 7/1972 | Haug | 89/42 B |
| 3,854,378 | 12/1974 | Vogel | 89/37 F |
| 3,968,445 | 7/1976 | Sherman | 328/58 |
| 4,004,495 | 1/1977 | Belfer | 89/42 B |
| 4,244,272 | 1/1981 | Terry | 89/41 A |
| 4,351,223 | 9/1982 | Schmidt | 89/41 SM X |

*Primary Examiner*—Richard E. Schafer
*Assistant Examiner*—David K. Cornwell
*Attorney, Agent, or Firm*—Pollock, Vande Sande & Priddy

[57] ABSTRACT

The present invention relates to means for reducing the gun firing dispersion in a weapon system. The gun (4) comprises a gun servo for aiming the gun at a target. A programmable signal generator (5) is arranged to produce a damping signal (z) which is supplied to the gun servo system at the firing of the gun and which signal has such a character that the oscillating movements which are generated at the firing of the gun are counteracted. A recoil sensor (6) is provided for sensing the start of the recoil movements of the gun and emitting a trigging pulse to the signal generator (5) which in turn is producing said damping signal (z) preferably in the form of a pulse train in which the number of pulses, the pulse widths, polarities and amplitudes of individual pulses can be varied and which has a certain time relationship with the gun firing moment.

10 Claims, 6 Drawing Figures

MEANS FOR REDUCING GUN FIRING DISPERSION

The present invention relates to means for reducing the dispersion of shots fired by a weapon system caused by the gun itself at firing and which gun includes a gun servo system for aiming the gun at a target.

The dispersion of fired shots caused by the gun itself at firing is often referred to as gun firing dispersion and in the following specification this expression will be used.

In a complete weapon system, for instance anti-aircraft gunnery, there are a number of factors which result in a dispersion of the shots. Up to now the contribution from the fire control equipment has been dominant and in prior weapon systems the efforts to reduce open firing dispersion have mainly been concentrated on reducing the contribution from the fire control equipment. This is also the reason why it has not previously been important to reduce other contributions to the dispersion of shots, such as the gun firing dispersion.

It is now possible to more precisely determine the position of a target and more sophisticated computers are used in fire control equipment, and these conditions are changing. To illustrate, it can be noted that the contribution to the distribution of shots caused by the fire control equipment was previously about 3–5 mrad and the gun firing dispersion about 0.5–2 mrad. Today it has been possible to reduce the fire control distribution to 1–3 mrad, i.e. the same magnitude as the gun firing dispersion. This means that efforts are now needed to reduce the gun firing dispersion.

The gun firing dispersion is mainly caused by the oscillating movements of the gun barrel and the elevating system generated through firing. For automatic guns having a high rate of fire and which for instance fire a series of ten shots, the gun firing dispersion is shown as a dispersion of the points of impact both laterally and in elevation. The points of impact of shots number two to ten in an automatic series which are generally located at an elevation other than that of the first shot in the series. Depending on the actual position of the moving gun barrel when the next shot in an automatic series is fired, the point of impact will be located at the upper part or at the lower part of the dispersion pattern. The frequency as well as the time interval between the shots varies depending on the number of shots in the loading system of the gun, temperature, play and friction in the elevation centre tap and in the elevation machinery. Both the frequency and time interval often vary $\pm 10\%$ which gives rise to a variation of the gun firing dispersion.

The magnitude of the gun firing dispersion is to a great extent determined by the angular position of the muzzle of the barrel at firing. The angular position of the muzzle depends on the oscillating movements, mainly bending oscillations, in the gun barrel and oscillating movements in the elevating system with respect to the upper carriage. The oscillations of the upper carriage, however, are often smaller and contribute only to a very small extent to the gun firing dispersion.

The oscillating movements of the gun barrel and elevating system have several grounds, for instance it depends on the forces in the recoil brakes, recoil forces on the upper carriage, forces generated by the screw mechanism when closing, opening and loading the chamber of the barrel.

A study of the oscillating movements has disclosed that different guns provide similar oscillations and that factors such as play and rigidity of the guns to some extent effect the oscillations. There is no clear connection between the shooting result and the play for different guns. In order to get an idea of the resulting oscillating movement it is necessary to measure the amplitudes of the oscillating movements at different locations on the gun. Such oscillating movements can for instance be recorded between the base cone and the upper carriage, between the breech casing and the upper carriage and between the barrel and the ground. For one such case the largest contribution to the angular position of the muzzle was obtained from the oscillating movements between the elevating system and the upper carriage, between the gun barrel and the breech casing and from bending oscillations in the gun barrel itself. The following magnitudes of the oscillation amplitudes were measured: between the upper carriage and the base cone 0.1 mrad, between the breech casing and the upper carriage 1 mrad and between the muzzle of the barrel and the ground 3 mrad.

As already mentioned it is only in the last years that measures have been taken to limit the gun firing dispersion. The methods which then have been used can be referred to one of the following two main types:

(a) a specific construction of the gun to minimize the oscillating movements of the gun barrel, (b) specific means introduced in the system for damping the oscillating movements.

Common for the methods according to the main type a are very heavy and complicated structures and therefore almost always expensive. One example of a method according to the main type b is the introduction of a strong arm for supporting the front part of the barrel. This method as well as other known methods according to main type b have the same disadvantages as the methods according to main type a, the means which have been used have made the gun construction heavier and more expensive. The main reason is that the means for damping the oscillating movements have been entirely mechanical.

SUMMARY OF THE INVENTION

The object of the present invention is to provide means for limiting the gun firing dispersion which eliminates the disadvantages of known mechanical damping means. The invention includes specific means to provide the gun servo with a signal at firing, the signal having a form to oppose the oscillating movements of the gun barrel at firing.

In a preferred embodiment the signal consists of a pulse train having a specific time relationship with the firing moment. Then a sensor is used for sensing the recoil movements of the gun.

The pulse train is preferably produced by means of a programmable signal generator which permits control of the number of pulses, the pulse widths, the polarities and amplitudes of the different pulses.

DESCRIPTION OF THE FIGURES

The invention will now be described more in detail in connection with the accompanying drawings which show a preferred embodiment of the invention and in which.

DESCRIPTION OF THE PREFERRED EMBODIMENT

Figure 1:
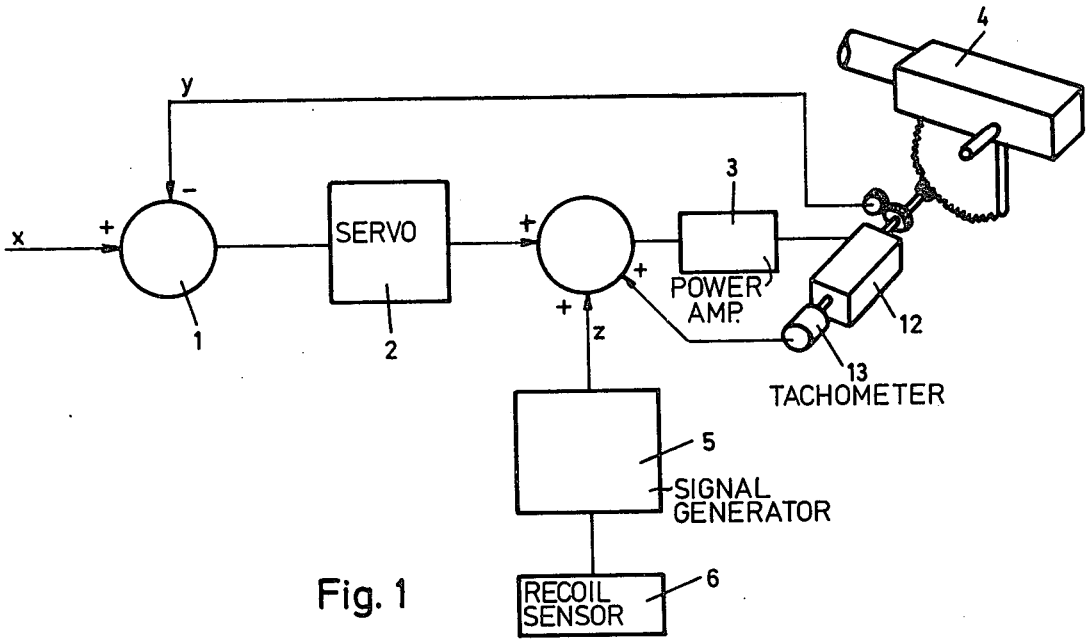
FIG. 1 is a schematic view of the gun servo.

An aiming or control system for a gun usually comprises both a traversing system and an elevating system. The two systems are analog systems and are entirely separate from each other. In the following, therefore, only one of the aiming systems, the elevating system, will be described in detail according to FIG. 1.

The aiming of the gun in elevation is determined by an angle of elevation which is commanded from fire control equipment (not shown), but the invention can also be used when the gun is controlled by a conventional hand control on the gun. The commanded angle of elevation x is fed to comparison means 1, for instance control transformer synchros, in the servo system and is compared with the actual angle of elevation y of the gun. From the comparison means an angular error signal x-y is obtained which signal corresponds to the difference between the commanded angle of elevation and the actual angle of elevation for the gun. The angular error signal is fed to a servo circuit 2 in which the signal is converted into an appropriate form and amplitude and thereafter fed to a power stage comprising a power amplifier 3 and a servo motor 12, for instance hydraulic or electric, for driving the gun until the angular error becomes zero. A conventional tachometer generator 13 is also connected to the elevation system for adding a signal to the output signal from the servo circuit 2. In some types of servo systems, however, the tachometer generator 13 is dispensable. All the components which have been mentioned now are known per se and will therefore not be described in detail.

Also the gun 4 which is controlled by the servo system is conventional and may for instance consist of a rapid-firing automatic gun with an elevating system mounted on an upper carriage in a gun turrett. The gun is elevated about a horizontal axis, the elevation centre tap, which is located as close as possible to the centre of gravity of the weapon.

Figure 2A:
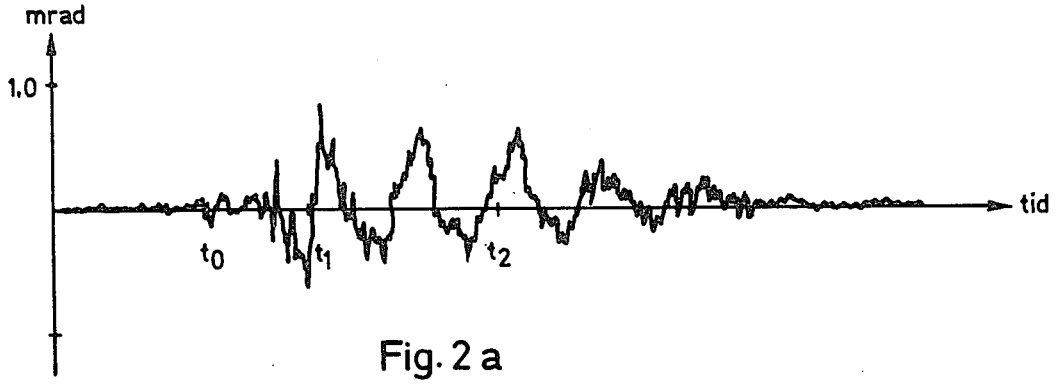

Even if the commanded elevation angle x from the fire control equipment is very precisely determined and the angular error x-y is reduced to zero, there is still a dispersion between the impact position of the shots. As mentioned in the introductory part of our specification this dispersion depends on the gun itself and is caused by oscillating movements of the gun barrel at firing. FIG. 2*a* illustrates typical oscillating movements recorded on the elevation centre tap at firing. The diagram shows the amplitude of the oscillating movement in mrad as a function of time in msec and from the figure it is understood that the amplitude has a maximum just after the gun has been fired, as indicated by the time $t_1$ in the figure, and is then attenuated after about 500 msec. Shot number two in an automatic series of shots is fired at the time $t_2$ and in this case the oscillation amplitude is 0.2 mrad. The rate of fire as well as the frequency of the oscillating movement varies, however, which means that the position of the gun barrel at the time $t_2$ may differ as much as $\pm 1$ mrad.

For an automatic gun salvo a number of similar oscillating movements as illustrated in FIG. 2*a* will be superimposed on each other which means that in some cases a gradually increasing amplitude of the resulting oscillating movement is obtained which in turn means that the gun firing dispersion increases even more. From FIG. 2*a* it is also understood that the oscillating movement starts at the time $t_0$, which is the ramming start moment.

FIG. 2*a* illustrates the oscillating movements for a conventional elevating system. In order to reduce the oscillations of the gun barrel, the elevating system according to our invention comprises a signal generator 5 for supplying a signal z to the servosystem at the moment of firing which signal has such a character that the gun barrel oscillations are counteracted, see FIG. 2*c* and *d*. The signal z is added to the error signal in the servo system before the power stage. A recoil sensor 6 is connected to the signal generator 5 for sensing the recoil start and triggering the signal generator. Such a recoil sensor is known per se and will not be described in detail.

The servo system and the gun 4 is controlled by the signal z provided by the signal generator 5. The form of the signal z is adapted to the form of the gun barrel oscillations so that the servo system in an optimal way is counteracting the gun barrel oscillations. The control of the generator signal is performed in the following way. First the oscillating movements of the gun barrel is recorded without damping. Then the generator signal z is controlled to a form for compensating oscillating movements. For that reason the signal generator 5 is programmable so that an appropriate output signal can be set easily just by programming the signal generator. One type of signal which gives a good damping of the oscillating movements of the gun barrel is shown in FIG. 2*c*. This signal consists of a series of pulses of constant amplitudes and widths but with alternating polarities and the signal is started with a certain time delay T after the start of recoil. As the gun barrel oscillations consists of a periodic oscillation with decreasing amplitude a better damping is attained if the generator signal consists of a periodic oscillation signal with a gradually decreasing amplitude and which is started with a time delay T so that it will be in opposition to the barrel oscillation. As to the duration of the generator signal the pulse train should end before the next shot in an automatic series. The form of a preferred decreasing damping signal is shown in FIG. 2*d*.

Figure 2B:
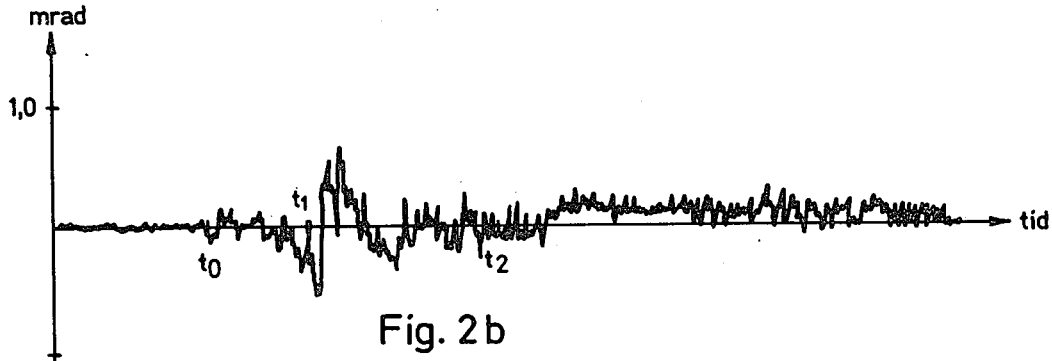
Figure 2C:
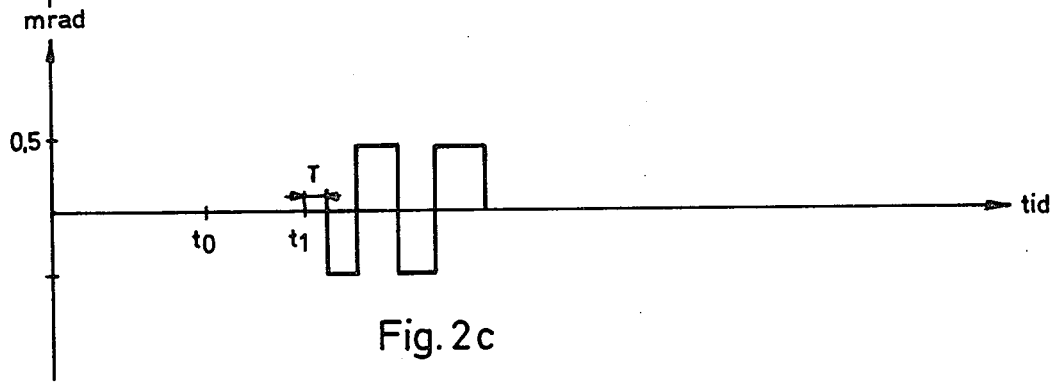
Figure 2D:
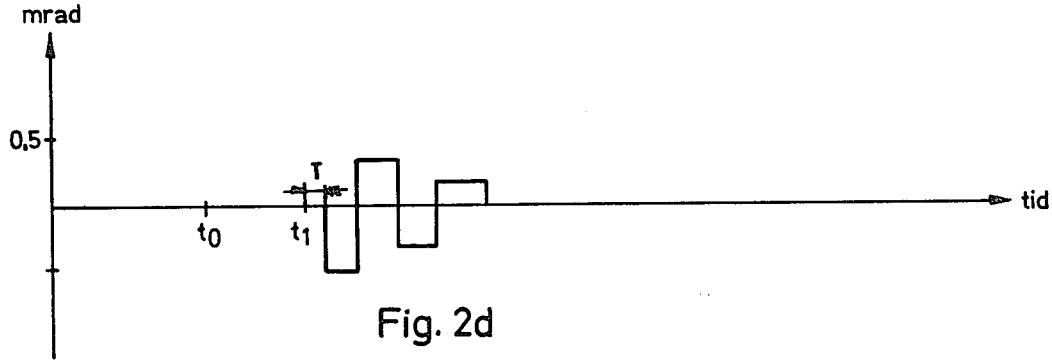

The corresponding oscillating movements of a gun barrel connected with a signal generator is illustrated in FIG. 2*b*. As shown in the figure a significant damping of the oscillating movement is obtained. At the firing moment for the second shot in an automatic series of shots the gun firing dispersion has been reduced to less than 0.1 mrad.

Figure 3:
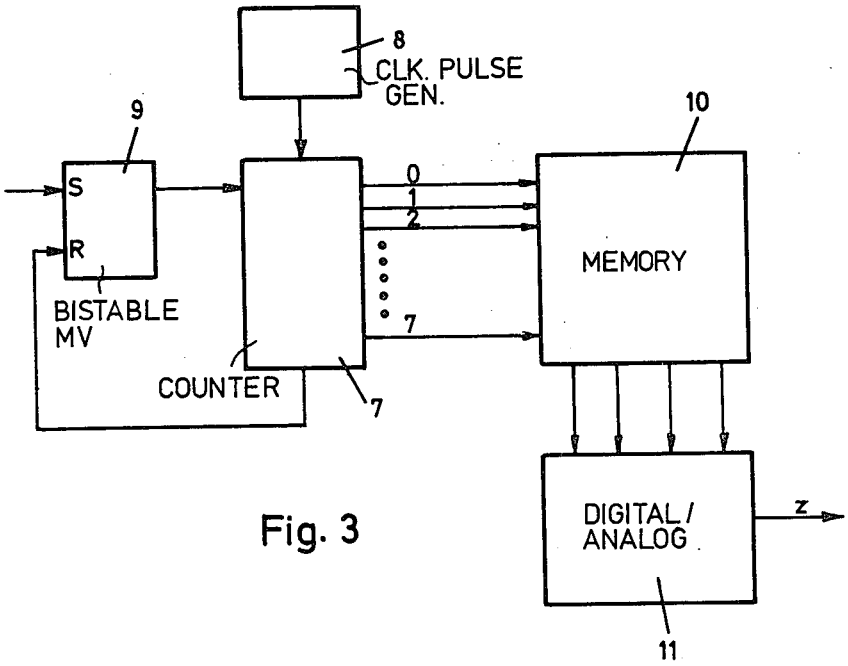
FIGS. 2*a* –2*d* shows diagrams of typical oscillating movements recorded on the elevation centre tap for a conventional gun servo system (a) as well as for a gun servo system according to the invention (b) and also two examples (c) and (d) of suitable damping signals and FIG. 3 is a block diagram of a signal generator generating a damping signal to the gun servo system.

FIG. 3 shows a schematic circuit diagram of a signal generator according to the invention. The signal generator comprises the following main elements: an 8-bit counter 7 for indicating actual time positions during a pulse train, a clock pulse generator 8 for driving the counter, a bistable multivibrator 9 for indicating start/-stop of the pulse train, a programmable memory 10 for storing the amplitudes for a number of time positions and a digital-to-analog converter 11.

When the recoil commences a triggering pulse is emitted by the recoil sensor 6 to the set-input terminal of the bistable multivibrator 9. The multivibrator emits an output signal to start the counting of the counter 7. The counter is connected to the clock pulse generator 8 having a frequency which is adjusted so as to allow the 8-bit counter to count its complete capacity of 256 pulses before the next shot is fired.

The clock pulse frequency may for instance be about 1 kHz. After a complete counting cycle a signal is emitted to the reset-input terminal of the bistable multivibrator 9 to indicate that the pulse train is finished. The counter is also addressing the element in the memory 10 storing the amplitude value for each time position. The memory can be a 256×4 bit memory for storing an amplitude value for each of the 256 time positions. The counter is then addressing this memory and reads out the amplitudes for each time position in succession. The digital-to-analog converter 11 converts the readout 4-bit word into an analog voltage signal which represents the damping signal and which is supplied to the servo system.

The invention is not limited to the described example but can be modified within the scope of the accompanying claims.

We claim:

1. In a weapon system having a servo system for aiming a gun at a target, said gun position controlled in response to a position error signal of said servo system, apparatus for reducing oscillation of said gun which results from firing inducing a firing dispersion of said gun, comprising:

signal generator means for generating at the time of firing said gun a signal which reduces the amplitude of said error signal produced from said firing whereby said oscillations are reduced;

means for sensing the firing of said gun; and means for applying said signal to said servo system in response to firing said gun, whereby a servo error signal which produces said gun oscillations is reduced.

2. Apparatus according to claim 1 wherein said signal generator means is connected to a recoil sensor for sensing when recoil movement of the gun commences.

3. Apparatus according to claim 1 wherein said signal generator means is programmable and the generator output signal comprises a pulse train in which the number of pulses, the pulse widths, the polarities and amplitudes of the individual pulses are programmable.

4. Apparatus according to claim 3 wherein the pulse train is started with a certain time delay after the firing moment or after the start of recoil of the gun.

5. Apparatus according to claims 3 or 4 wherein the pulses of the pulse train have a constant amplitude but varying polarities.

6. Apparatus according to claim 3 or 4 wherein the amplitudes of the pulses of the pulse train are gradually decreasing and the pulses have varying polarities.

7. Apparatus according to claim 3 wherein the output signal from the signal generator means is fed to the servo system before a power stage of said servo system.

8. Apparatus according to claim 7 wherein the recoil sensor emits a triggering pulse to a set-input terminal of bistable multivibrator when the recoil movements of the gun commences.

9. In a weapon system including a servo mechanism for generating a positioning signal for a gun in response to an angular error signal, said position signal being amplifed in a power amplifier for driving a positioning motor, an apparatus for reducing oscillation of said gun during firing comprising:

a clock pulse generator;

a counter connected to be incremented by said clock pulse generator;

a flip-flop connected to said counter to enable said counter upon receipt of a signal on one input, and disable said counter upon receipt of an overflow signal from said counter;

a memory programmed to include amplitude levels, said memory connected to be addressed by said counter;

a digital to analog converter connected to receive said memory addressed amplitude levels, and connected to provide an analog level to said power amplifier input; and a recoil sensor connected to provide a triggering signal to said one input where, during recoil of said gun, said counter increments reading amplitude levels from said memory which form a compensating signal for reducing said oscillations.

10. Apparatus according to claim 9 wherein the frequency of the clock pulse generator is adapted to allow the counter to count its complete counting cycle before the next shot is fired by the gun.

* * * * *